US011072988B2

(12) United States Patent
Deacon et al.

(10) Patent No.: US 11,072,988 B2
(45) Date of Patent: Jul. 27, 2021

(54) FLUID CONTROL SYSTEM

(71) Applicant: Expro North Sea Limited, Aberdeen (GB)

(72) Inventors: Paul Deacon, Aberdeen (GB); Dariusz Szpunar, Elrick Westhill (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 16/471,335

(22) PCT Filed: Dec. 19, 2017

(86) PCT No.: PCT/GB2017/053798
§ 371 (c)(1),
(2) Date: Jun. 19, 2019

(87) PCT Pub. No.: WO2018/115838
PCT Pub. Date: Jun. 28, 2018

(65) Prior Publication Data

US 2020/0115982 A1 Apr. 16, 2020

(30) Foreign Application Priority Data

Dec. 21, 2016 (GB) ..... 1621892

(51) Int. Cl.
*E21B 33/035* (2006.01)
*E21B 34/04* (2006.01)
*E21B 34/16* (2006.01)

(52) U.S. Cl.
CPC ..... *E21B 33/0355* (2013.01); *E21B 34/04* (2013.01); *E21B 34/16* (2013.01); *E21B 2200/04* (2020.05)

(58) Field of Classification Search
CPC ..... E21B 33/0355; E21B 34/04; E21B 34/16; E21B 2200/04
USPC ..... 166/368
See application file for complete search history.

(56) References Cited

U.S. PATENT DOCUMENTS

| | | | |
|---|---|---|---|
| 4,095,421 A | 6/1978 | Silcox | |
| 4,880,060 A | 11/1989 | Schwendemann et al. | |
| 2014/0152723 A1* | 6/2014 | Yamashita | G09G 3/3233 345/691 |
| 2017/0152723 A1 | 6/2017 | Deacon et al. | |

* cited by examiner

*Primary Examiner* — Matthew R Buck
*Assistant Examiner* — Patrick F Lambe
(74) *Attorney, Agent, or Firm* — Getz Balich LLC

(57) ABSTRACT

A fluid control system includes an apparatus comprising a first and second fluid port, first and second control lines, a valve arrangement being configurable between a first state in which the first fluid port is in fluid communication with the first control line and the second fluid port is in fluid communication with the second control line, wherein the apparatus is switchable between first and second configurations responsive to pressure differentials between the first and second control lines, and a second state in which the second fluid port is in fluid communication with a pressurized line and the first fluid port is in fluid communication with a vent arrangement to thereby configure the apparatus into the second configuration, and a control arrangement for reconfiguring the valve arrangement between the first and second states in response to an actuation signal.

20 Claims, 5 Drawing Sheets

FLUID CONTROL SYSTEM

This application claims priority to PCT Patent Appln. No. PCT/GB2017/053798 filed Dec. 19, 2017, which claims priority GB Patent Appln. No. 1621892.7 filed Dec. 21, 2016, which are herein incorporated by reference.

BACKGROUND OF THE INVENTION

1. Technical Field

Some examples disclosed herein relate to a fluid control system, in particular a fluid control system for operating an apparatus.

2. Background Information

Landing strings are used in the oil and gas industry for through-riser or open water deployment of equipment, such as completion architecture, well testing equipment, intervention tooling and the like into a subsea well from a surface vessel. When in a deployed configuration the landing string extends between the surface vessel and the wellhead, for example a wellhead Blow Out Preventor (BOP). While deployed the landing string provides many functions, including permitting the safe deployment of wireline or coiled tubing equipment through the landing string and into the well, providing the necessary primary well control barriers and permitting emergency disconnect while isolating both the well and landing string.

Wireline or coiled tubing deployment may be facilitated via a lubricator valve which is located proximate the surface vessel, for example below a rig floor.

Well control and isolation in the event of an emergency disconnect is provided by a suite of valves which are located at a lower end of the landing string, normally positioned inside the central bore of the BOP. The BOP therefore restricts the maximum size of such valves. The valve suite includes a lower valve assembly called the subsea test tree (SSTT) which provides a safety barrier to contain well pressure, and an upper valve assembly called the retainer valve which isolates the landing string contents and can be used to vent trapped pressure from between the retainer valve and SSTT. A shear sub component extends between the retainer valve and SSTT which is capable of being sheared by the BOP if required.

As noted above, the landing string may accommodate wireline and/or coiled tubing deployed tools. In this respect the various valve assemblies, such as in the SSTT, must define sufficiently large internal diameters to permit unrestricted passage therethrough. However, the valve assemblies also have outer diameter limitations, for example as they must be locatable within the wellhead BOP. Such conflicting design requirements may create difficulty in, for example, achieving appropriate valve sealing, running desired tooling through the valves and the like.

Furthermore, the landing string must be capable of cutting any wireline or coiled tubing which extends therethrough in the event of an emergency disconnect. It is known in the art to use one or more of the valves to shear through the wireline or coiled tubing upon closure. However, providing a valve with the necessary cutting capacity may be difficult to achieve within the geometric design constraints associated with the landing string. For example, the valve actuators must be of sufficient size to provide the necessary closing/cutting forces, which may be difficult to accommodate within the restricted available size.

The landing string must also be designed to accommodate the significant in-service loadings, such as the global tension from a supported lower string (e.g., a test string, completion or the like), bending loads, valve actuation loading, internal and external pressures and the like. As the industry continues to move into fields with increasing formation and water depths, the resulting structural demands on the landing string also become more extreme. For example, landing string global tension requirements far in excess of 4.5 MN (1,000,000 lbf) and wellbore pressures in the region of 690 bar (10,000 psi) are typical. Such loadings must be accommodated across regions including the various valve assemblies, such as the SSTT. It is therefore necessary to design the valve housings and appropriate end connections to be capable of accommodating the global applied tension, bending loads, valve actuation loading and pressures. This results in the use of thick walled valve housings, which can compromise the achievable valve internal diameters and sealing integrity. Furthermore, current industry standards call for all connections through such landing string valve assemblies to be configured to avoid separation during use to improve fatigue performance. Such connections may include bolted connections of the valve housings into the landing string. This typically requires significant upsizing of the connections and establishes further difficulties in achieving sufficiently large internal diameters within the outer diameter constraints, such as dictated by the BOP.

Issues such as those described above are not unique to valves within landing string applications. For example, there is a general desire in the art to minimize the size of valves, for example to provide minimal valve housing dimensions while still maximizing the inner diameter to accommodate appropriate valve mechanisms and the like.

SUMMARY OF THE INVENTION

A fluid control system, comprising: an apparatus comprising a first and second fluid port; first and second control lines; a valve arrangement being configurable between: a first state in which the first fluid port is in fluid communication with the first control line and the second fluid port is in fluid communication with the second control line, wherein the apparatus is switchable between first and second configurations responsive to pressure differentials between the first and second control lines; and a second state in which the second fluid port is in fluid communication with a pressurized line and the first fluid port is in fluid communication with a vent arrangement to thereby configure the apparatus into the second configuration; and a control arrangement for reconfiguring the valve arrangement between the first and second states in response to an actuation signal.

The apparatus may be, comprise or be comprised in a latch, a coupling, a valve or the like. The first configuration may be an engaged, open or operational configuration. The second configuration may be a disengaged, closed or non-operational configuration.

The apparatus may be pressure operated, e.g. by pressurized fluid.

The valve arrangement may be configured such that, in the first state, pressurization of the first control line to a higher pressure than the second control line configures the apparatus into the first configuration, and pressurization of the second control line to a higher pressure than the first control line configures the apparatus into the second configuration.

The apparatus may be biased towards a particular configuration, for example the second configuration. The apparatus may be biased towards a particular configuration by means of a biasing device providing a constant biasing force, such as a spring. The apparatus may be a fail-safe and/or fail close apparatus.

Where the apparatus is biased towards a particular configuration, the valve arrangement may be configured such that, in the first state, pressurization of the second control line and the biasing force of the biasing device act to configure the apparatus into the second configuration, and pressurization of the first control line acts to configure the apparatus into the first configuration. The biasing device may assist to reduce the pressure required in the second control line in order to configure the apparatus into the second configuration. The pressure required in the second control line in order to configure the apparatus into the second configuration may be relative to the pressure in the first control line. Where the apparatus is biased towards a particular configuration, the pressure required in the second control line to configure the apparatus into the second configuration may be lower than the instant pressure in the first control line.

Where the apparatus is biased towards a particular configuration, the valve arrangement may be configured such that, in the second state, pressurization of the first control line, as well as the biasing force of the biasing device, acts to configure the apparatus into the second configuration, and the second control line is depressurized via the vent arrangement. The biasing device may assist to reduce the pressure required in the first control line in order to configure the apparatus into the second configuration.

Pressurization of the first control line to a pressure higher than the combined effect of both pressure in the second control line and a biasing force, provided by the biasing device, may act to configure the apparatus into the first configuration. Pressurization of the second control line together with a biasing force producing a higher force than the force resulting from application of pressure in the first control line may act to configure the apparatus into the second configuration.

When the valve arrangement is in the first state, pressurized fluid may be selectively and/or controllably provided to one or both of the first fluid port and/or the second fluid port in order to switch the apparatus between first and second configurations. The supply and/or pressure of the fluid to the first and/or second control lines may be controlled remotely from the valve arrangement, e.g. at or towards the surface. The apparatus may be operable between the first and second configurations responsive to a pressure differential between the first fluid port and the second fluid port. The apparatus may be configurable into the first configuration by pressurizing the first port to a higher pressure than the second port. The apparatus may be configurable into the second configuration by pressurizing the second port to a higher pressure than the first port.

The pressurized line in fluid communication with the second fluid port when the valve arrangement is in the second state may be the first control line of the fluid control system. The pressurized line in fluid communication with the second fluid port when the valve arrangement is in the second state may be, or may be in fluid connection with, a first control line of a different fluid control system.

The valve arrangement may be configured to switch the first control line from being in communication with the first fluid port to being in communication with the second fluid port when the valve arrangement is reconfigured to the second state from the first state, which may thus reverse the function of the first control line from configuring the apparatus into the first configuration to configuring the apparatus into the second configuration. The second control line may be isolated when the valve arrangement is in the second state.

In use, the valve arrangement of the fluid control system may normally be configured in the first state, and the control arrangement may be used to reconfigure the valve arrangement into the second state only in certain conditions, for example in the event of an emergency.

In an embodiment, the valve arrangement of the fluid control system may be switchable from the first state to the second state to reconfigure the apparatus from the first (e.g. operational) configuration to the second (e.g. non-operational) configuration by re-routing or reconfiguring the first control line. Reconfiguration of the valve arrangement from the first state to the second state may permit a pressure communicated to the first fluid port via the first control line to be switched to the second fluid port. Thus, the valve arrangement may allow pressure being communicated to the first fluid port via the valve arrangement to be redirected towards the second fluid port. The valve arrangement may allow the user to rapidly switch between providing a pressure at the first fluid port to a second fluid port, quicker than may be possible if the user were to provide a signal, for example a pressure signal, to the second fluid port via use of the second control line.

The valve arrangement may comprise one valve or multiple valves. The valve arrangement may comprise one valve which is functionally equivalent to a configuration of multiple valves. The valve arrangement may comprise multiple valves contained in a single valve housing. In one example, the valve arrangement may comprise at least two valves. The valve arrangement may comprise at least a first valve and a second valve.

The first valve may be coupled between the first fluid port and the first control line and/or the vent arrangement. The first valve may be a three-way valve. The first valve may be reconfigurable between a first valve configuration in which the first control line is in fluid communication with the first fluid port, e.g. through the first valve, and a second valve configuration in which the first valve prevents fluid communication between the first control line and the first port, e.g. through the first valve. In the second valve configuration, the first valve may isolate the first control line from the first fluid port of the apparatus. In the second valve configuration, the vent arrangement may be in fluid communication with the first fluid port, e.g. through the first valve. In the first valve configuration, the first valve may isolate the vent arrangement from the first fluid port of the apparatus.

The second valve may be coupled between the second fluid port and the second control line and/or the pressurized line (e.g. the first control line or a first control line from a different fluid control system). The second valve may be a three-way valve. The second valve may be reconfigurable between a first valve configuration in which the second control line is in fluid communication with the second fluid port, e.g. through the second valve, and a second valve configuration in which the second valve prevents fluid communication between the second control line and the second port, e.g. through the second valve. In the second configuration, the second valve may isolate the second control line from the second fluid port of the apparatus. In the second valve configuration, the pressurized line may be in fluid communication with the second fluid port, e.g. through the second valve. In the first valve configuration, the second valve may isolate the pressurized line from the second fluid port of the apparatus.

The first and second valves may be in the first valve configuration when the valve arrangement is in the first state. The first and second valves may be in the second valve configuration when the valve arrangement is in the second state. The first and second valves may be reconfigurable between the first and second valve configurations responsive to the control arrangement.

The valve arrangement (e.g. the first and second valves) may be configurable in response to a trigger, such as a common trigger, e.g. from the control arrangement. The first and second valves of the valve arrangement may be substantially simultaneously operable or reconfigurable between the first and second valve configurations. The trigger may be or comprise pressure, e.g. from a pressure source, which may be a common pressure source. The valve arrangement (e.g. the first and second valves) may be in selective communication with the pressure source. Substantially simultaneous operation of the first and second valves of the valve arrangement may result from substantially simultaneous exposure to the common pressure source. Substantially simultaneous operation of the first and second valves may reduce the likelihood of certain undesirable events, such as unintentional operation of the apparatus, pressure lock occurring in a control line, damage to components due to overexposure to pressure or to pressure build-up in a control line, general valve synchronization issues, and/or the like.

In a further example, the valve arrangement may comprise a single valve. Where the valve arrangement comprises a single valve, it may perform the same function as the configuration wherein the valve arrangement comprises two or more valves, e.g. a first and a second valve.

The single valve may be coupled between the first and second fluid ports, the pressurized line (e.g. the first control line or a first control line from a different fluid control system), the second control line and the vent arrangement. The single valve may be a five-way valve. The single valve may be reconfigurable between a first valve configuration in which the first control line is in fluid communication with the first fluid port and the second control line is in fluid communication with the second fluid port (e.g. via the single control valve), and a second valve configuration in which the single valve prevents fluid communication between both the first control line and the first fluid port and the second control line and the second fluid port. In the second valve configuration, the single valve may isolate the first control line from the first fluid port of the apparatus, and the second control line from the second fluid port of the apparatus. In the second valve configuration, the vent arrangement may be in fluid communication with the first fluid port, and the pressurized line may be in fluid communication with the second fluid port (e.g. via the single control valve). In the first valve configuration the single valve may isolate the vent arrangement form the first fluid port of the apparatus, and may isolate the pressurized line from the second fluid port of the apparatus.

The control arrangement may comprise a control valve, for example a three-way or five-way control valve. The control valve may be an electrically operated valve. The control valve may be operable responsive to the actuation signal, which may be an electrical signal. The control valve may be or comprise a solenoid operated valve (SOV) or other suitable electrically operated valve. An electrically operated control arrangement may be easily and flexibly run into a riser or wellbore, and may be relatively compact compared to other possibilities, for example compared to hydraulic or pneumatic operation.

The control valve may be coupled between the pressure source and the valve arrangement (e.g. the first and second valves). The first and second valves may be pressure operated valves, e.g. operable responsive to a pressure applied to respective control ports of the first and second valves. The control valve may be configured such that operation of the control valve configures (e.g. simultaneously configures) the first and second valves between the first and second configurations. The control valve may be operable between at least a first control condition in which the pressure source is isolated from the valve arrangement and a second control condition in which the pressure source is in fluid communication with the valve arrangement, e.g. with respective control ports of the first and second valves. In the second control condition, the control ports of the first and second valves may be in fluid communication with a vent or the vent arrangement that is also coupled to the first valve. The control valve may be operable between the first and second control conditions (e.g. responsive to the actuation signal) to operate or reconfigure the first and second valves, e.g. between the first and second valve configurations.

The valve arrangement (e.g. at least the first and second valves of the valve arrangement) may be pressure controlled or actuated. A pressure may be used to change the state of the valve arrangement. For example, the valve arrangement may be connected to a pilot line. The pilot line may be or provide the pressure source. A pilot pressure in the pilot line may be used to configure the valve arrangement between the first state and the second state. Pressurization of the pilot line may act to reconfigure the valve arrangement by physically moving the valve arrangement (e.g. the first and second valves of the valve arrangement) in response to the pressure.

The valve arrangement may be configurable from the first state to the second state on exposure to the pilot pressure. Upon removal and/or isolation from the pilot pressure, the valve arrangement may reconfigure to the first state from the second state. Reconfiguration from the first state to the second state may be at least partly or wholly as a result of the valve arrangement being normally biased towards a particular state.

The pilot pressure may be run and/or controllable from the surface of a well.

The valve arrangement may be normally biased towards the first state. The valve arrangement may be normally biased by means of a biasing device providing a constant biasing force, such as a spring. Having a constant normal biasing force may reduce the complexity of the system as it removes the need for, for example, a constant pressure to be applied to the valve arrangement during normal operation to maintain the valve in the desired state.

The valve arrangement may be coupled to the vent arrangement. The vent arrangement may permit pressure at the first fluid port to be vented. The vent arrangement may permit at least a portion of the first control line to be vented. Venting the control line or fluid port may reduce the pressure therein, and therefore may have an effect on the configuration of the apparatus, e.g. may cause the valve arrangement to reconfigure. The vent arrangement may connect to the first control line via the valve arrangement. Similarly, the vent arrangement may connect to the first fluid port via the valve arrangement.

The vent arrangement may permit excess or unwanted pressure to be vented to an exterior location, for example to a wellbore annulus.

The control arrangement may have a first control configuration in which pressurization of the pilot line downstream of the control arrangement is restricted, and a second control configuration in which pressurization of the pilot line downstream of the control arrangement is permitted. When the control arrangement is in the first control configuration, pressure in the pilot line downstream of the control arrangement may be vented.

The control arrangement may be normally biased towards a particular control configuration. For example, the control arrangement may be normally biased towards a configuration in which pressurization of the pilot line is blocked, and thus the valve arrangement is in the first control configuration. In the case of a failure of the control arrangement, for example a disturbance in the electrical signal to the control arrangement, the control arrangement may be configured to adopt either the first or second control configuration or may be configured to remain in its configuration.

Pressure may be provided to the fluid control system via a high pressure source. Where the fluid control system is used by a rig and is located subsea or subsurface, the high pressure source may be located on the surface. The fluid control system may communicate with the high pressure source via a fluid conduit, such as tubing, piping, hoses or the like.

A remote high pressure source, for use by the fluid control system, may be provided subsea or subsurface. The remote high pressure source may be stored subsea or subsurface in a container, for example in an accumulator bottle. Pressure may be able to be discharged from the remote high pressure source into the fluid control system, and the remote high pressure source may be able to be recharged by pressure in the fluid control system. For example, the remote high pressure source may comprise an attachment to the first and/or second control line and may provide pressure to that control line instead of, or in addition to, a high pressure source located on the surface. When the remote high pressure source is not needed to discharge pressurized fluid into the fluid control system, it may recharge by withdrawing pressurized fluid from the fluid control system, the fluid having been provided by a high pressure source located on the surface. Having access to a remote high pressure source may enable additional pressurized fluid to be accessed when required. This may enable the apparatus response time to be reduced, or may provide access to pressurized fluid if, for example, there is a blockage or failure at the surface high pressure source.

The apparatus of the fluid control system may be an apparatus suitable for use subsea. For example, the apparatus may be a valve, such as a ball valve. Alternatively, the apparatus may be a connection apparatus. For example, the apparatus may comprise a latch, a set of dogs, hooks, fingers etc. for connection with a secondary object or apparatus, which may be subsea, downhole, or the like.

The apparatus may be hydraulically or pneumatically operable. The apparatus may be operable by application of pressure in the first and/or second control line.

In the event that there is no pressure applied to either the first or second control lines, for example due to a leak of control fluid or a blockage in a control line, the apparatus may be configured to adopt a certain configuration. For example, in the event that no pressure is applied to either the first or second control lines, the apparatus may be configured to adopt the second configuration (e.g. the disengaged, closed or non-operational configuration). In this way, the apparatus may be considered to be a fail-closed apparatus. The use of such an apparatus in the fluid control system may improve the overall level of safety of the fluid control system.

The fluid control system may be positioned within a riser, or BOP or the like so as to protect it from damage. For example the control lines may be located, within an annular space (e.g. an annular space in a riser or BOP), or the like to protect them from damage, e.g. severance, from external objects.

The fluid control system may be useable to control multiple apparatuses, and may correspondingly comprise multiple valve arrangements.

An aspect may relate to a system comprising at least two of the fluid control systems according to the previous aspect. The pressurized line of the apparatus of at least one of the fluid control systems may be, or be coupled to, the first control line of at least one other fluid control system. The apparatus of at least one of the fluid control systems may be a fail closed apparatus. The apparatus of at least one of the fluid control systems may be a fail as is apparatus. The pressurized line of the at least one fail as is fluid control system may be, or be coupled to, the first control line of the at least one fail closed fluid control system.

An aspect may relate to a method for use of a fluid control system, comprising; establishing communication between a first control line and a first fluid port via a valve arrangement and communication between a second control line and a second fluid port via the valve arrangement; providing an actuation signal to a control arrangement; reconfiguring a valve arrangement between a first and a second configuration in response to the actuation signal; establishing communication between a pressurized line (such as the first control line) and the second fluid port via the reconfigured valve arrangement, and establishing communication between the first fluid port and a vent apparatus so as to vent the first fluid port.

It should be understood that the features defined above in accordance with any aspect of the present invention or below in relation to any specific embodiment of the invention may be utilized, either alone or in combination with any other defined feature, in any other aspect or embodiment of the invention. Furthermore, the present invention is intended to cover apparatus configured to perform any feature described herein in relation to a method and/or a method of using or producing or manufacturing any apparatus feature described herein.

DETAILED DESCRIPTION OF THE INVENTION

Aspects of the present invention relate to a fluid control system. Such a fluid control system may be used in numerous applications. However, one specific exemplary application will be described below.

Figure 1:
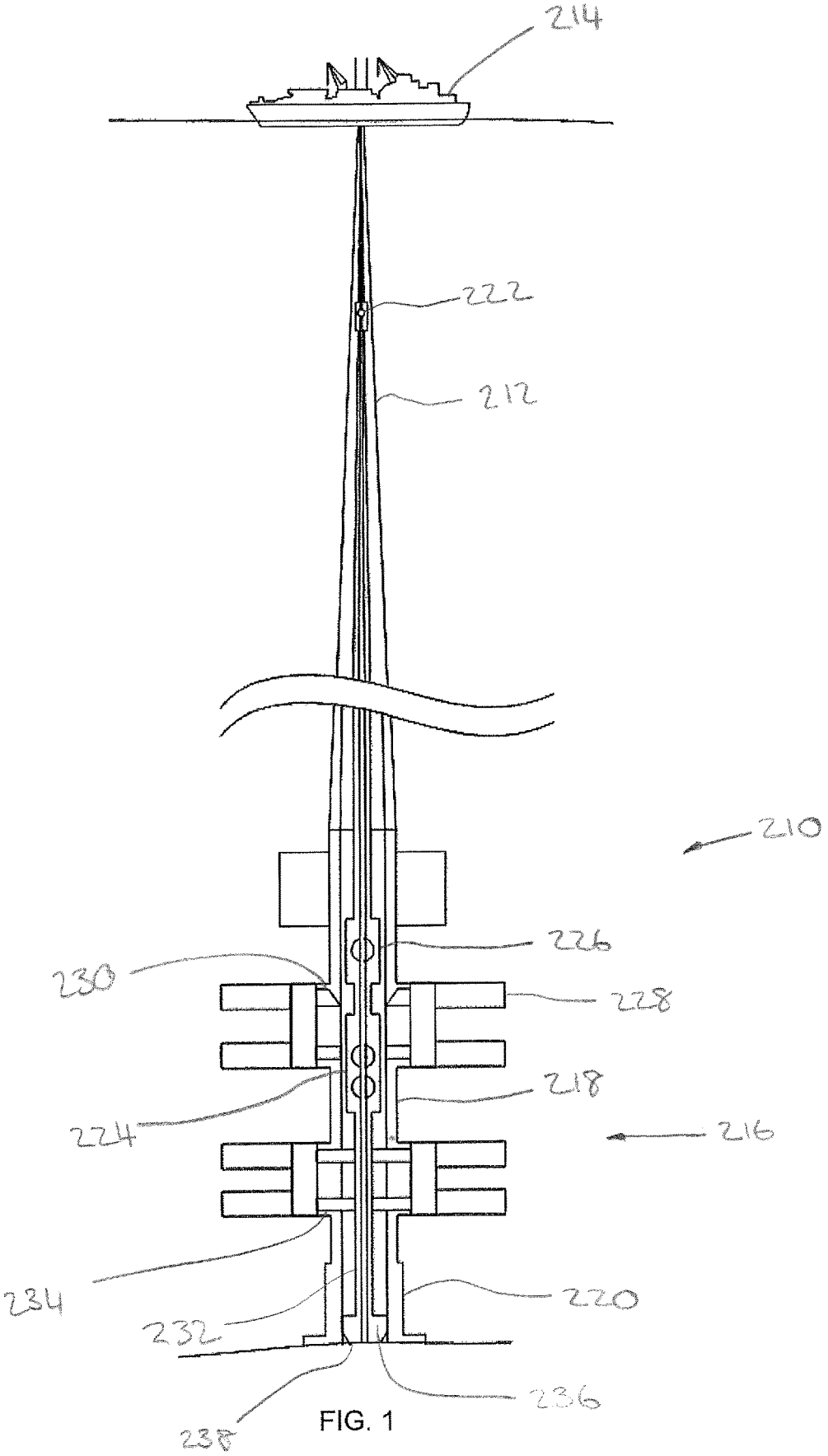
FIG. 1 is a diagrammatic illustration of a landing string assembly.

A landing string assembly 210 is diagrammatically illustrated in FIG. 1, shown in use within a riser 212 extending between a surface vessel 214 and a subsea wellhead assembly 216 which includes a BOP 218 mounted on a wellhead 220. The use and functionality of landing strings are well known in the art for through-riser deployment of equipment, such as completion architecture, well testing equipment, intervention tooling and the like into a subsea well from a surface vessel.

When in a deployed configuration the landing string 210 extends through the riser 212 and into the BOP 218. While deployed, the landing string 210 provides many functions, including permitting the safe deployment of wireline or coiled tubing equipment (not shown) through the landing string and into the well, providing the necessary primary well control barriers and permitting emergency disconnect while isolating both the well and landing string 210.

Wireline or coiled tubing deployment may be facilitated via a lubricator valve 222 which is located proximate the surface vessel 214.

Well control and isolation in the event of an emergency disconnect is provided by a suite of valves which are located at a lower end of the landing string 210 inside the BOP 218. The valve suite includes a lower valve assembly called the subsea test tree (SSTT) 224 which provides a safety barrier to contain well pressure, and also functions to cut any wireline or coiled tubing which extends through the landing string 210. The valve suite also includes an upper valve assembly called the retainer valve 226 which isolates the landing string contents and can be used to vent trapped pressure from between the retainer valve 226 and SSTT 224. A shear sub component 228 extends between the retainer valve 226 and SSTT 224 which is capable of being sheared by shear rams 230 of the BOP 218 if required. A slick joint 232 extends below the SSTT 224 which facilitates engagement with BOP pipe rams 234.

The landing string 210 may include an interface arrangement for interfacing with other oil field equipment. For example, in the present embodiment the landing string 210 includes a tubing hanger 236 at its lowermost end which engages with a corresponding casing hanger 238 provided in the wellhead 220. When the landing string 210 is fully deployed and the corresponding tubing hanger 236 and casing hanger 238 are engaged, the weight of the lower string (such as a completion, workover string or the like which extends into the well and thus not illustrated) becomes supported through the wellhead 220. However, during deployment of the lower string through the riser 212 all the weight and other forces associated with the lower string must be entirely supported through the landing string 210. Furthermore, when deployed a degree of tension is conventionally applied to the landing string 210, for example to prevent adverse compressive forces being applied, for example due to the weight of the landing string 210, which can be significant in deep water. The landing string 210 must thus be designed to accommodate significant in-service loadings, such as the global tension and bending loads from a supported lower string. Such in-service loadings, which may also include valve actuation loading, internal and external pressures and the like, must be accommodated across the various valve assemblies, such as the SSTT 224. It is therefore necessary to design the valve housings and appropriate end connections to be capable of accommodating the global applied tension, bending loads, valve actuation loading, pressures and the like.

Figure 2A:
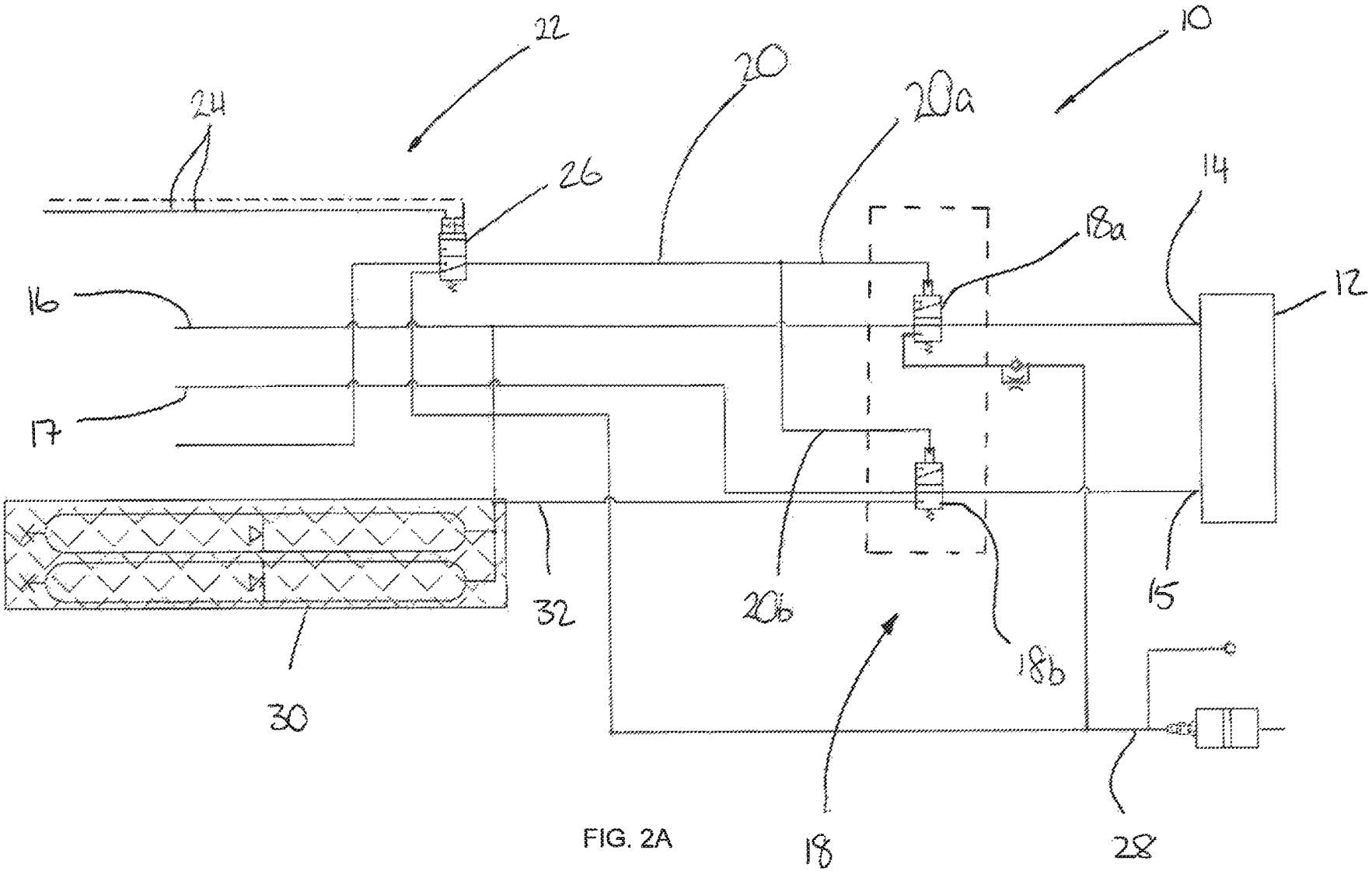
FIG. 2A is an example of a fluid control system comprising a valve arrangement in the first state.

A diagrammatic example of a fluid control system 10 is illustrated in FIG. 2A. The fluid control system 10 comprises apparatus 12 comprising a first fluid port 14 and a second fluid port 15. In use, the fluid ports 14, 15 may permit the flow of a fluid into and out of the apparatus. In this way, the fluid ports 14, 15 may permit the apparatus 12 to be hydraulically operated.

A first control line 16 and a second control line 17 are connected to the first fluid port 14 and second fluid port 15 respectively, via a valve arrangement 18.

In this example, the valve arrangement 18 comprises two valves 18*a*, 18*b*, and is shown in FIG. 2A in a first state wherein valve 18*a* permits communication of the first control line 16 with the first fluid port 14, and valve 18*b* permits communication of the second control line 17 with the second fluid port 15.

In this example, the valves 18*a*, 18*b* of the valve arrangement 18 are hydraulically operated by pilot line 20. The pilot line 20 comprises two branches 20*a*, 20*b* which communicate hydraulic fluid to valves 18*a*, 18*b* respectively, thus allowing the valve arrangement 18 to be configured between a first and a second state. Although described in this example as being hydraulically operated, valves 18*a*, 18*b* may be operated in any other appropriate way. For example valves 18*a*, 18*b* may be operated by pneumatic means, electrical means or the like.

A control arrangement 22 is connected to pilot line 20. In this example, the control arrangement 22 is electrically operated by electrical lines 24. Electrical lines 24 are used to operate a solenoid valve (SOV) 26. In this example, only one of the electrical lines 24 may be used to operate the SOV, and the other may be provided as a backup in the case of failure of a line 24. In the configuration shown in FIG. 2A, the SOV 26 is acting to block a pilot pressure in the pilot line 20 upstream of the SOV 26 from actuating valves 18*a*, 18*b* of the valve arrangement 18. At the same time, the SOV 26 connects the portion of the pilot line 20 downstream of the SOV 26 to a vent arrangement 28.

FIG. 2A also illustrates accumulator bottles 30. The accumulator bottles 30 are in communication with the first control line 16 via bypass line 32. The accumulator bottles 30 may be used to provide a source of pressurized hydraulic fluid to the first control line 16 or, as will be described in more detail below, a source of pressurized hydraulic fluid to the second fluid port 15, thus acting to reconfigure the apparatus 12 to the second configuration. Such a pressure source may reduce the response time of the apparatus 12 by assisting to reconfigure the apparatus 12 to the second configuration. Additionally or alternatively, the pressure source may be required to provide the apparatus 12 with a pressure source if, for example, there is a blockage or leakage of hydraulic fluid from the pressure source at surface.

The vent arrangement 28 is further connected to the first control line 16 via the valve 18*a* of the valve arrangement 18. As shown in FIG. 2A, the vent arrangement 28 is blocked from communication with first control line 16 by the valve 18*a*.

Figure 2B:
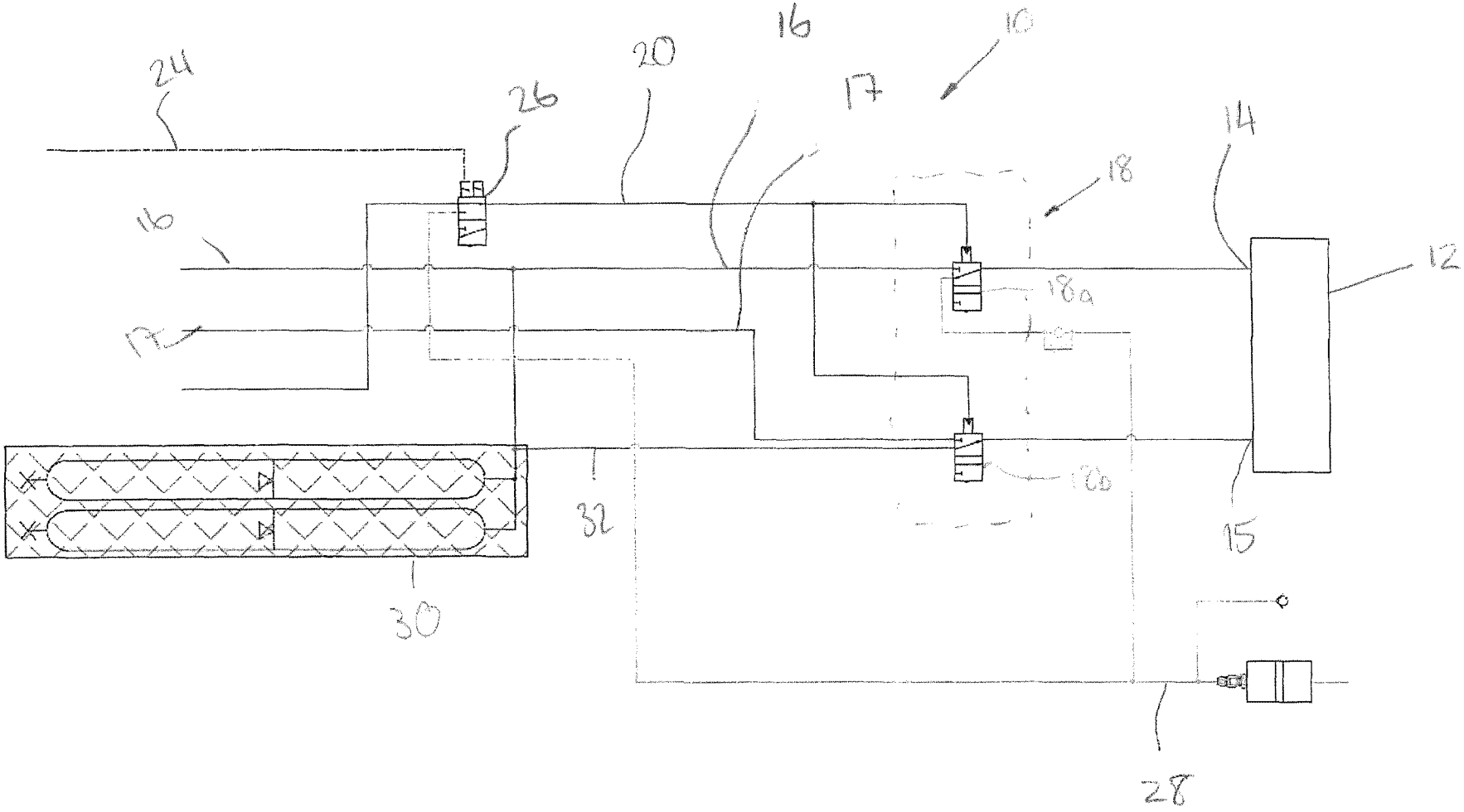
FIG. 2B is an example of a fluid control system comprising a valve arrangement in the second state.

FIG. 2B illustrates the fluid control system 10 with the valve arrangement 18 in a second state, showing the same components as FIG. 2A.

In this example the SOV 26 receives an electrical signal from one of the electrical lines 24 which causes the SOV 26 to permit pilot pressure to reach the valve arrangement 18. Once the pilot line 20 downstream of the SOV 26 is pressurized, the valve arrangement 18 moves to the second state. In the second state the valve 18*a* blocks communication of the first control line 16 with the first fluid port 14. Valve 18*b* blocks communication of the second control line 17 with the second fluid port 15, and when the valve arrangement 18 is in the second state communication of the first control line 16 with the second fluid port 15 via the bypass line 32 is established. Further, the valve arrangement 18 being in the second state permits communication of the accumulator bottles 30 with the second fluid port 15. Since pressurization of the second fluid port 15 relative to the first fluid port 14 acts to configure the apparatus 12 to a disengaged configuration, then pressurization of the first control line 16 now acts to configure the apparatus 12 to a disengaged configuration. At the same time, the valve 18*a* opens communication of the first fluid port 14 with the vent arrangement 28 and any pressure at the first fluid port 14 may be vented.

Figure 3A:
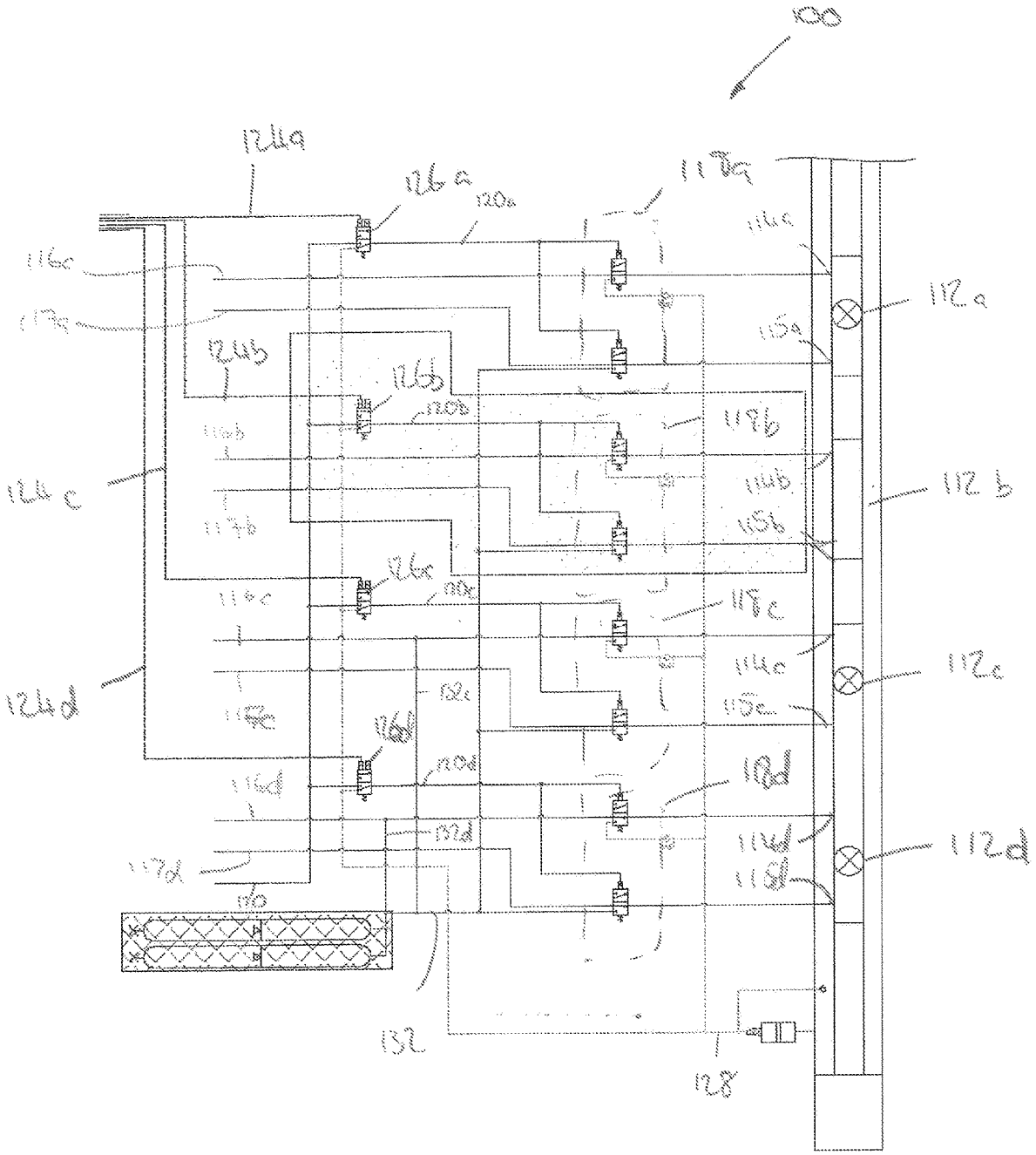
FIG. 3A is a system of four fluid control systems, each comprising a valve arrangement in the first state.

FIG. 3A illustrates a system 100 comprising four fluid control systems similar to that shown in FIGS. 2A and 2B. Many of the components shown in FIGS. 2A and 2B are the same or similar to those shown in FIG. 3A, and as such the reference numerals are the same but augmented by 100.

In the system 100 of FIG. 3A, electrical lines, 124*a-d* connect to each of the fluid control systems. Having separate electrical lines 124*a-d* connecting to each of the fluid systems may permit the SOVs 126*a-d* of each fluid control system to be operated separately, and thus each of the fluid control systems may be able to be switched from the first to the second configuration independently of each of the other fluid control systems.

Each of the SOVs 126*a-d* share a common pilot line 120, which branches off into individual pilot lines 120*a-d* for each of the individual fluid control systems.

Each of the fluid control systems of FIG. 3A comprises a separate valve arrangement 118*a-d* that permits communication between the each first and second control line, 116*a-d*, 117*a-d* and the respective first and second fluid ports 114*a-d*, 115*a-d* via the valve arrangement 118*a-d*. Each of the fluid control systems of FIG. 3A are in the first configuration as described in FIG. 2A, and as such each first control line 116*a-d* is in communication with each first fluid port 114*a-d*.

In the example shown in FIG. 3A, only the first control lines 116*c* and 116*d* comprise a bypass line 132*c*, 132*d*. As with FIG. 2A and FIG. 2B, the bypass lines 132*c*, 132*d*, permit communication of the first control lines 116*c* and 116*d* with the second fluid ports 115*c*, 115*d* when the fluid control system is in its second configuration. In this example, the bypass lines 132*c*, 132*d* converge into a single bypass line, 132, before branching out to connect to valve arrangements 118*a-d*. As such, whilst the valve arrangements 118*c* and 118*d* are provided with bypass lines 132*c*, 132*d*, the valve arrangements 118*a*, 118*b* have the connection from the common bypass line 132. The valve arrangements 118*c* and 118*d* are fail closed valves and as such, it would be expected that their control lines 116*c*, 116*d* would be pressurized in use.

Connection of the first control line 116*c*, 116*d* to the valve connected to the second fluid port 115*c*, 115*d* by the bypass 132*c*, 132*d* in the second state would be expected to supply the pressure to close the apparatus 112*c*, 112*d*, as these are fail-safe and/or fail closed valves and thus pressure may be required to close these valves. However, since the apparatuses 112*a*, 112*b* are fail as is apparatus, it is not necessarily the case that the first control lines 116*a*, 116*b* for these apparatus 112*a*, 112*b* will be pressurized. Hence, the common bypass line 132 is used instead to provide the pressure to the valves that are connected to the second fluid ports 115*a*, 115*b* when in the second configuration. The bypass 132*c*, 132*d* is additionally connected to the accumulator bottles 30, and may allow for the charging or recharging of the accumulator bottles 30, for example by providing a supply of surface pressure thereto.

In one embodiment, the fail-safe and/or fail closed valves 112*c*, 112*d* may not require pressurization of the second fluid port 115*c*, 115*d* to close, and therefore may not require a connection to bypass 132*c*, 132*d*. In this instance, valves 112*c*, 112*d* may close by some other means, for example by means of a biasing device. In this example, bypass 132*c*, 132*d* may function solely for recharging of the accumulator bottles 30.

In this example, the apparatuses 112*a-d* are not all the same. Apparatuses 112*a*, 112*c* and 112*d* are ball valves, such as might be used as a retainer valve, while the apparatus 112*b* is a connection arrangement, which permits connection of the upper ball valve 112*a* with the lower ball valves 112*c*, 112*d*.

Figure 3B:
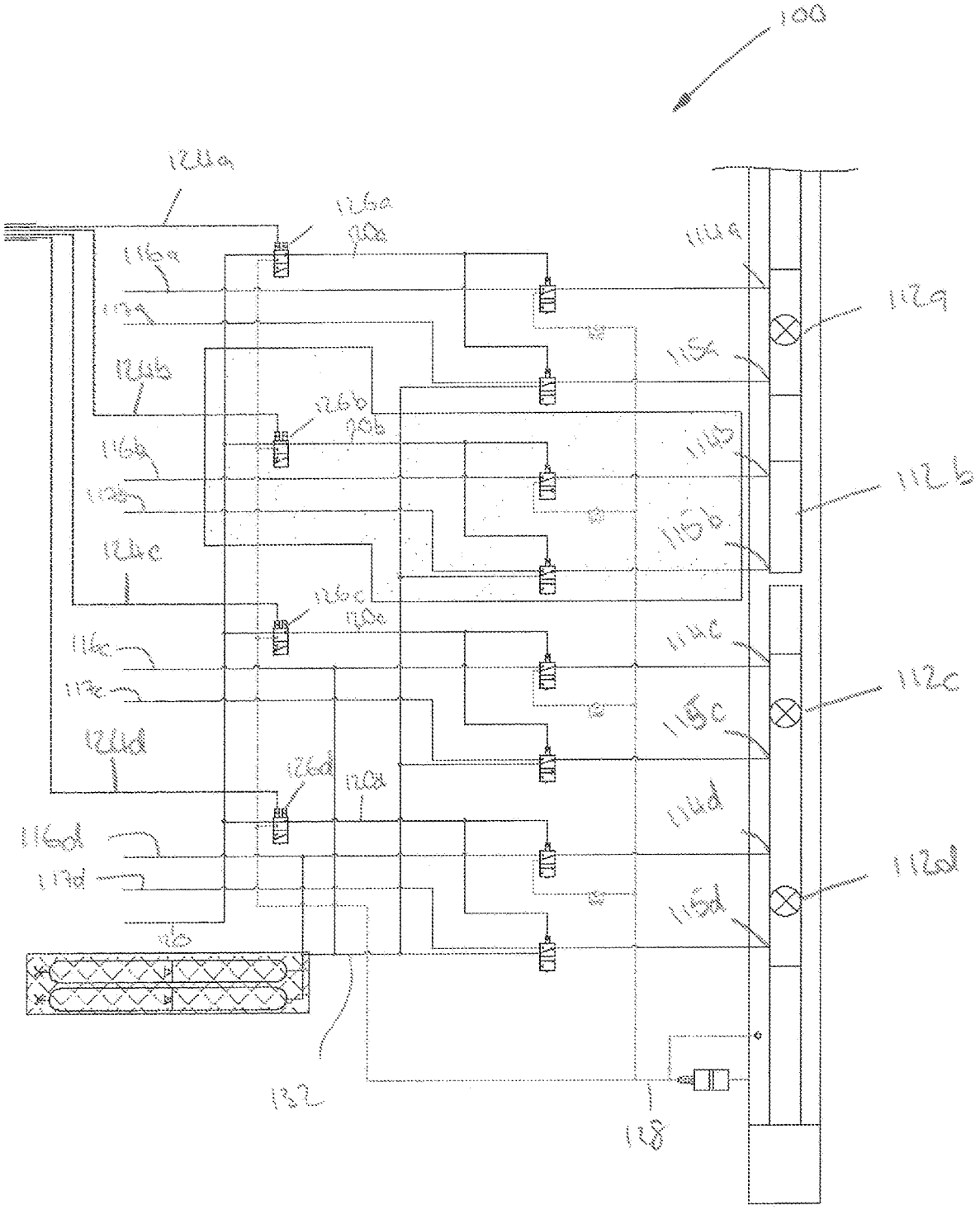
FIG. 3B is a system of four fluid control systems, each comprising a valve arrangement in the second state.

In FIG. 3B, the system 100 is shown with the fluid control systems in their second configurations. As described above in FIG. 2B, the SOVs 126*a-d* receive an electrical signal from electrical lines 124*a-d*, permitting the pressurization of the pilot lines 120*a-d* downstream of SOVs 126*a-d* and therefore reconfiguration of the valve arrangements 118*a-d* to the second state. In this case, communication between first control lines 116*a-d* the first fluid port 115*a-d* is blocked, while pressure at the first fluid port 114*a-d* is vented via the vent arrangement 128. At the same time, communication between the second control lines 117*a-d* and the second fluid ports 115*a-d* is also blocked, and communication between the first control lines 116*c*, 116*d* and the second fluid ports 115*a-d* is established via the bypass arrangement 132.

Pressurization of the second fluid ports 115*a-d* via the first control lines 116*a-d* causes the apparatuses 112*a-d* to move to the disengaged configuration. In this example, this means the ball valves of apparatuses 112*a*, 112*c*, 112*d* moving towards a closed position, and the connection arrangement of apparatus 112*b* disengaging.

While certain embodiments have been described, these embodiments have been presented by way of example only, and are not intended to limit the scope of the invention. Indeed the novel methods and systems described herein may be embodied in a variety of other forms. Furthermore, various omissions, substitutions and changes in the form of the methods and systems described herein may be made without departing from the spirit of the invention. The accompanying claims and their equivalents are intended to cover such forms and modifications as would fall within the scope of the invention.

The invention claimed is:

1. A fluid control system, comprising:

an apparatus comprising a first fluid port and a second fluid port, wherein the apparatus is operable between first and second configurations;

a first control line and a second control line;

a valve arrangement being configurable between:

a first state in which the first fluid port is in fluid communication with the first control line and the second fluid port is in fluid communication with the second control line, wherein, when the valve arrangement is in the first state, the apparatus is reversibly switchable between the first and second configurations in accordance with the direction of a pressure differential between the first and second control lines; and a second state in which the second fluid port is in fluid communication with a pressurized line and the first fluid port is in fluid communication with a vent arrangement to thereby permit venting of pressure at the first fluid port, and configure the apparatus into the second configuration; and a control arrangement for reconfiguring the valve arrangement between the first and second states in response to an actuation signal.

2. The system of claim 1, wherein the apparatus is pressure operated and the valve arrangement is configured such that, in the first state, pressurization of the first control line to a higher pressure than the second control line configures the apparatus into the first configuration, and pressurization of the second control line to a higher pressure than the first control line configures the apparatus into the second configuration.

3. The system of claim 2, wherein, when the valve arrangement is in the first state, pressurized fluid may be selectively and/or controllably provided to the first fluid port or the second fluid port in order to switch the apparatus between first and second configurations.

4. The system of claim 2, wherein pressurization of the first control line to a pressure higher than the combined effect of pressure in the second control line and a biasing force which biases the apparatus towards the second configuration acts to configure the apparatus into the first configuration, and the pressurization of the second control line together with a biasing force producing a higher force than the force resulting from application of pressure in the first control line, acts to configure the apparatus into the second configuration.

5. The system of claim 1, wherein the pressurized line in fluid communication with the second fluid port when the valve arrangement is in the second state is one of the first control line of the fluid control system and a first control line of a different fluid control system.

6. The system of claim 1, wherein the valve arrangement is configured to switch the first control line from being in communication with the first fluid port to being in communication with the second fluid port when the valve arrangement is reconfigured to the second state from the first state to thereby configure the apparatus from the first configuration into the second configuration.

7. The system of claim 1, wherein the valve arrangement of the fluid control system is switchable from the first state to the second state to reconfigure the apparatus from the first position to the second position by re-routing or reconfiguring the first control line such that pressure communicated to the first fluid port via the first control line is switched to the second fluid port.

8. The system of claim 1, wherein the valve arrangement comprises at least a first valve and a second valve, the first valve being coupled between the first fluid port and at least one of the first control line and the vent arrangement, and the second valve is coupled between the second fluid port and at least one of the second control line and the pressurized line.

9. The system of claim 8, wherein the first valve is reconfigurable between a first valve configuration in which the first control line is in fluid communication with the first fluid port and a second valve configuration in which the first valve prevents fluid communication between the first control line and the first port, and wherein, in the second valve configuration, the first valve isolates the first control line from the first fluid port of the apparatus and the vent arrangement is in fluid communication with the first fluid port through the first valve.

10. The system of claim 8, wherein the second valve is reconfigurable between a first valve configuration in which the second control line is in fluid communication with the second fluid port and a second valve configuration in which the second valve prevents fluid communication between the second control line and the second port.

11. The system of claim 10, wherein, in the second configuration, the second valve isolates the second control line from the second fluid port of the apparatus and the pressurized line is in fluid communication with the second fluid port through the second valve.

12. The system of claim 8, wherein the first and second valves of the valve arrangement are substantially simultaneously operable or reconfigurable between the first and second valve configurations.

13. The system of claim 8, wherein the control arrangement is coupled between a pressure source and the valve arrangement and the valve arrangement is pressure operated.

14. The system of claim 13, further comprising a control valve is operable between at least a first control condition in which the pressure source is isolated from the valve arrangement and a second control condition in which the pressure source is in fluid communication with the valve arrangement and the control valve is operable between the first and second control conditions to operate or reconfigure the first and second valves between the first and second valve conditions.

15. The system of claim 1, wherein the valve arrangement comprises a single valve reconfigurable between a first valve configuration in which the first control line is in fluid communication with the first fluid port and the second control line is in fluid communication with the second fluid port, and a second valve configuration in which the single valve prevents fluid communication between both the first control line and the first fluid port and the second control line and the second fluid port.

16. The system of claim 1, wherein the control arrangement comprises an electrically operated valve responsive to an electrical actuation signal.

17. The system of claim 1, wherein the valve arrangement is biased towards the first state.

18. The system of claim 1, further comprising a remote high pressure source, for use by the fluid control system, provided subsea or subsurface and configured such that pressure can be discharged from the remote high pressure source into the fluid control system, and the remote high pressure source is able to be recharged by pressure in the fluid control system, wherein the remote high pressure source comprises an attachment to the first and/or second control line and provides pressure to that control line instead of, or in addition to, a high pressure source located on the surface.

19. A system comprising at least two of the fluid control systems according to claim 1, wherein the pressurized line of the apparatus of at least one of the fluid control systems is in fluid communication with the first control line of at least one other fluid control system, and wherein the apparatus of at least one of the fluid control systems is a fail closed apparatus and the apparatus of at least one of the fluid control systems is a fail as is apparatus, wherein the pressurized line of the at least one fail as is fluid control system is in fluid communication with the first control line of the at least one fail closed fluid control system.

20. A method for use of a fluid control system, comprising:

establishing, when a valve arrangement is in a first state, communication between a first control line and a first fluid port via the valve arrangement and communication between a second control line and a second fluid port via the valve arrangement;

providing an actuation signal to a control arrangement;

reconfiguring the valve arrangement between the first state and a second state in response to the actuation signal;

establishing, when the valve arrangement is in the second state, communication between a pressurized line and the second fluid port via the reconfigured valve arrangement; and establishing, when the valve arrangement is in the second state, communication between the first fluid port and a vent arrangement so as to vent pressure at the first fluid port to configure the apparatus into the second configuration.

* * * * *